US011359557B2

(12) United States Patent
Jayasankaran et al.

(10) Patent No.: US 11,359,557 B2
(45) Date of Patent: Jun. 14, 2022

(54) METHOD AND SYSTEM FOR LOAD CONTROL IN AN INTERNAL COMBUSTION ENGINE

(71) Applicant: Caterpillar Inc., Peoria, IL (US)

(72) Inventors: Karthik Jayasankaran, Dunlap, IL (US); Joshua T. Annin, Lafayette, IN (US); Christopher F. Gallmeyer, Chillicothe, IL (US); Alex M. Kubiak, W. Lafayette, IN (US); Kamalakannan Thammireddi Vajram, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/884,657

(22) Filed: May 27, 2020

(65) Prior Publication Data

US 2021/0372333 A1 Dec. 2, 2021

(51) Int. Cl.
*F02D 41/00* (2006.01)
*F02D 33/00* (2006.01)

(52) U.S. Cl.
CPC ..... *F02D 41/0002* (2013.01); *F02D 33/00* (2013.01); *F02D 41/009* (2013.01); *F02D 2200/0404* (2013.01); *F02D 2200/06* (2013.01); *F02D 2200/101* (2013.01)

(58) Field of Classification Search
CPC ..... F02D 33/00; F02D 41/00; F02D 41/0002; F02D 41/009
See application file for complete search history.

(56) References Cited

U.S. PATENT DOCUMENTS

| | | | | |
|---|---|---|---|---|
| 4,634,887 | A * | 1/1987 | Balch | F02D 31/007 290/3 |
| 5,408,974 | A * | 4/1995 | Lipinski | F02D 17/02 123/198 F |
| 6,778,893 | B2 | 8/2004 | Murakami et al. | |
| 7,263,428 | B2 | 8/2007 | Kobayashi et al. | |
| 8,701,628 | B2 * | 4/2014 | Tripathi | F02D 37/02 123/350 |
| 9,745,905 | B2 * | 8/2017 | Pirjaberi | F02D 41/0002 |
| 2004/0245034 | A1 * | 12/2004 | Miyamoto | F02D 41/22 180/170 |
| 2009/0192698 | A1 * | 7/2009 | Smuda | F02D 41/0027 701/106 |

(Continued)

FOREIGN PATENT DOCUMENTS

| | | |
|---|---|---|
| JP | 2009057901 A | 3/2009 |
| JP | 2009074486 A | 4/2009 |

(Continued)

*Primary Examiner* — John Kwon
*Assistant Examiner* — Johnny H Hoang
(74) *Attorney, Agent, or Firm* — Bookoff McAndrews PLLC

(57) ABSTRACT

A method for controlling an internal combustion engine includes receiving a request for a desired output from the internal combustion engine, receiving sensor information indicative of at least an engine speed or a pressure of gas provided to the internal combustion engine, and setting a changeable limit associated with a supply of air and fuel to the internal combustion engine. The method also includes, based at least in part on the received sensor information, changing the changeable limit to define a changed limit and reducing an output of the internal combustion engine based on the changed limit.

19 Claims, 4 Drawing Sheets

(56) References Cited

U.S. PATENT DOCUMENTS

| | | | | |
|---|---|---|---|---|
| 2010/0256890 | A1* | 10/2010 | Baldauf | F02D 41/0027 701/102 |
| 2011/0048373 | A1* | 3/2011 | Okoshi | F02D 31/003 123/399 |
| 2014/0046576 | A1* | 2/2014 | Chamarthi | F02D 41/26 701/108 |
| 2014/0235403 | A1* | 8/2014 | Gilbert | B60W 10/06 477/36 |
| 2016/0208831 | A1* | 7/2016 | Ancha | F15B 19/005 |
| 2017/0082048 | A1* | 3/2017 | Endo | F02D 41/023 |
| 2018/0195486 | A1* | 7/2018 | Sawada | F02P 5/15 |

FOREIGN PATENT DOCUMENTS

| | | | |
|---|---|---|---|
| JP | 5109197 | B2 | 2/2012 |
| JP | 5995894 | B2 | 9/2016 |
| WO | 2015/099448 | | 7/2015 |

* cited by examiner

METHOD AND SYSTEM FOR LOAD CONTROL IN AN INTERNAL COMBUSTION ENGINE

TECHNICAL FIELD

The present disclosure relates generally to internal combustion engine systems, and more particularly, to methods and systems for controlling and estimating load of an internal combustion engine.

BACKGROUND

Internal combustion engines are used in various applications, including challenging environments that require the production of significant amounts of power, placing significant loads on the engine. High-performance and high-power engines, including natural gas engines, diesel engines, and dual fuel engines (engines capable of combusting both natural gas and diesel fuel), and others, are capable of operating under particularly high loads. Such engines can be capable of generating large amounts of power, and therefore tend to have a relatively high rated output or maximum desired load. In order to prevent damage, conventional engine systems may monitor some engine parameters and apply safety limits to avoid applying excessive force or stress to engine components. While these safeguards may be helpful in avoiding catastrophic damage, existing systems may allow engines to operate above a desired maximum power or maximum load for significant periods of time. Operating an engine at such high outputs, and in particular, operating an engine at an output higher than its rated or maximum desired output, may result in accelerated wear, or even damage to one or more components of the engine.

In order to prevent damage that can occur when a maximum rated power is significantly exceeded, some engine control units estimate a current workload of the engine. However, as these calculations are imprecise, these engines may regularly exceed a rated load and experience damage and increased wear that occurs when an engine is operated above a maximum rated workload for a prolonged period of time.

An exemplary ignition controller for an engine is disclosed in JPS59-095894 B2 to Ihata et al. (the '894 patent). The '894 patent describes an estimating means for estimating load factor of an engine based on fluctuations in velocity of a crankshaft. This estimated load factor may be used to calculate a desired ignition timing. However, the ignition controller described in the '894 patent may not prevent an engine from exceeding a desired power. Additionally, while this ignition controller may estimate load factor based on fluctuations in engine speed, including fluctuations at wide open throttle, it may not address certain aspects affecting accuracy of the calculation of load factor.

The disclosed method and system may solve one or more of the problems set forth above and/or other problems in the art. The scope of the current disclosure, however, is defined by the attached claims, and not by the ability to solve any specific problem.

SUMMARY

In one aspect, a method for controlling an internal combustion engine may include receiving a request for a desired output from the internal combustion engine, receiving sensor information indicative of at least an engine speed or a pressure of gas provided to the internal combustion engine, and setting a changeable limit associated with a supply of air and fuel to the internal combustion engine. The method may also include, based at least in part on the received sensor information, changing the changeable limit to define a changed limit and reducing an output of the internal combustion engine based on the changed limit.

In another aspect, an internal combustion engine control system may include an internal combustion engine, a throttle, a sensor configured to generate a signal indicative of an engine speed, and a controller. The controller may be configured to receive the signal indicative of the engine speed, set a limit associated with an output of the internal combustion engine, based at least in part on the signal indicative of the engine speed, change the limit to define a changed limit, and generate a command signal to control a position of the throttle based on the changed limit.

In yet another aspect, a method for determining a load factor of an internal combustion engine may include receiving an engine speed signal from a sensor, determining a load factor based on at least the engine speed signal, adjusting the load factor, based on at least one of an emissions condition of the internal combustion engine or a timing of the internal combustion engine, to determine a corrected load factor, and operating the internal combustion engine based at least in part on the corrected load factor.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," "substantially," "generally," and "approximately" are used to indicate a possible variation of ±10% in the stated value.

Figure 1:
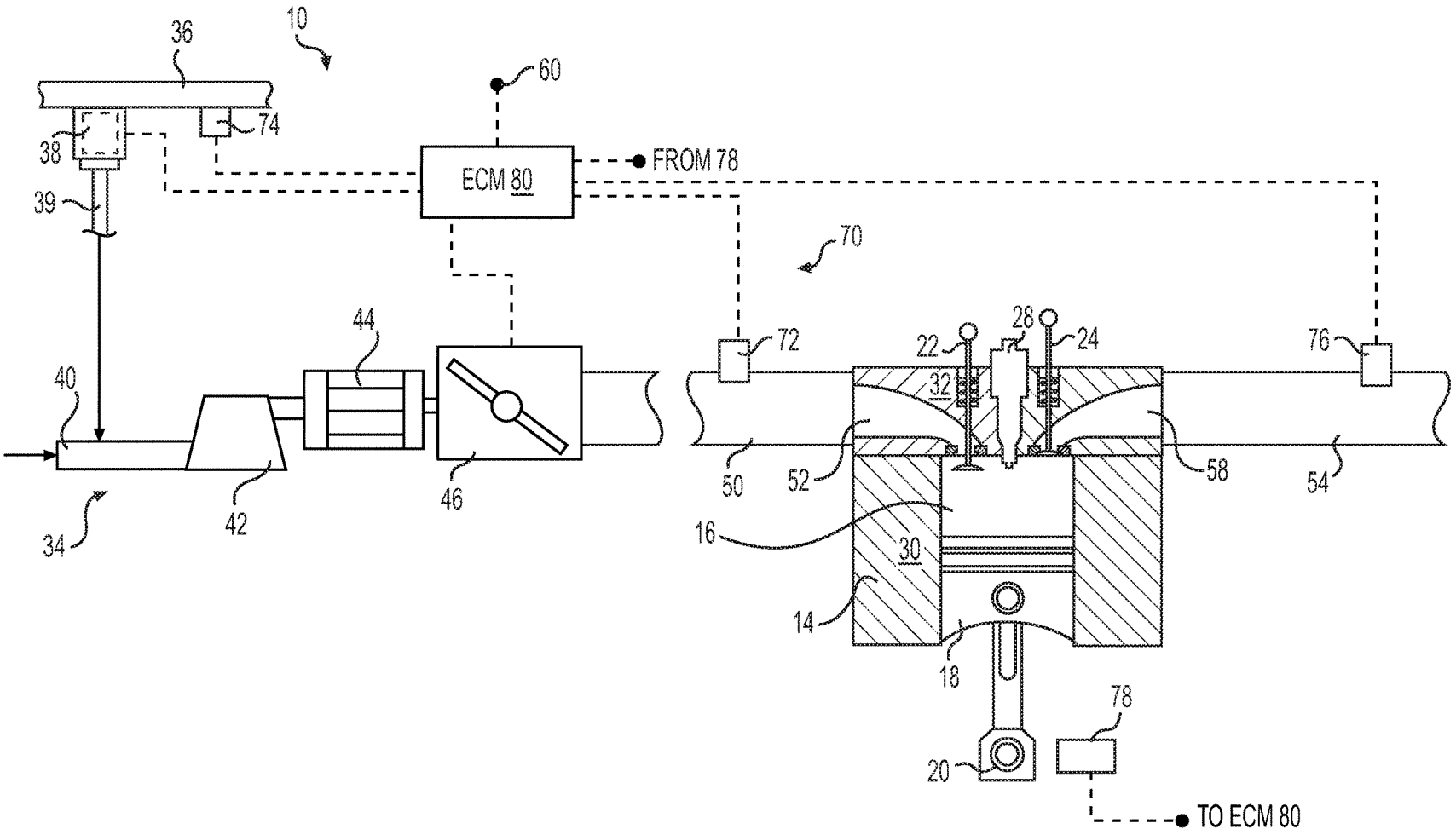
FIG. 1 is a schematic diagram illustrating an engine load control system according to an aspect of the present disclosure.

FIG. 1 is a schematic diagram illustrating an engine load control system 10 for determining and controlling a load factor of an internal combustion engine 14. Engine load control system 10 may include internal combustion engine 14, an air and fuel system 34, a sensor system 70, and one or more control units, such as electronic control module (ECM) 80. System 10 may include additional components, including an aftertreatment system for treating exhaust gas, and one or more fuel storage systems, etc. ECM 80 may be configured to monitor and control various aspects of the operation of internal combustion engine 14 and systems associated with internal combustion engine 14, such as air and fuel system 34. Internal combustion engine 14 may be any suitable reciprocating internal combustion engine configured to combust gaseous fuel, such as natural gas, propane gas, methane gas, or any other fuel in gaseous form. For example, internal combustion engine 14 may be a dual-fuel engine configured to operate in a mode in which both diesel fuel and gaseous fuel are combusted.

Internal combustion engine 14 may include an engine block 30, a cylinder head or engine head 32, a combustion chamber 16 defined by block 30 and head 32, and a piston 18 configured to reciprocate within the engine block 30. Engine 14 may include an ignition device 28, such as a spark plug suitable for initiating combustion of one or more types of gaseous fuel. Piston 18 may be operably connected to a crankshaft 20. While one combustion chamber 16 and piston 18 are illustrated in FIG. 1, internal combustion engine 14 may include a plurality of cylinders (e.g., twenty cylinders), each of which defines a respective combustion chamber 16, and each having a respective piston 18.

Air and fuel system 34 may include a gaseous fuel rail 36 containing pressurized fuel gas, an admission or fuel metering valve 38, an admission passage 39 which may form an exemplary fuel supply, an air inlet 40, a compressor 42, a cooler 44, and an intake throttle valve (ITV) 46 upstream of an intake manifold 50. Air inlet 40 may include one or more intake conduits configured to receive a flow of air from outside of engine 14. Metering valve 38 may be selectively opened to permit a controlled flow of gaseous fuel from fuel rail 36 to air inlet 40 via admission passage 39. Compressor 42 may be connected to a turbine (not shown) of a turbocharger (not shown) to compress a flow of air (and fuel from passage 39). Cooler 44 may be configured to reduce a temperature of this compressed air and fuel, which may be provided to engine 14 via ITV 46 and intake manifold 50. Air and fuel system 34 may be connected to combustion chamber 16 by an intake port 52. An intake valve 22, shown in an open position in FIG. 1, may be configured to selectively permit communication between intake port 52 and combustion chamber 16. An exhaust valve 24, shown in a closed position in FIG. 1, may selectively permit communication between exhaust port 58 and combustion chamber 16. An exhaust manifold 54 may be secured to engine 14 to receive exhaust from combustion chamber 16.

Sensor system 70 of load control system 10 may include one or more sensors, including: an intake sensor 72, a fuel sensor 74, an exhaust sensor 76, an engine speed sensor 78, and other suitable sensors (e.g., temperature sensors, vibration sensors, etc.) suitable to facilitate control and supervision of the operation of engine 14 via ECM 80. In at least some aspects, intake sensor 72 may include a pressure sensor (e.g., an intake manifold absolute pressure or IMAP sensor) configured to detect pressure of an air and fuel mixture at a location downstream of ITV 46. If desired, intake sensor 72 may include one or more temperature sensors configured to detect a temperature at intake manifold 50. One or more fuel sensors 74 may be configured to detect a pressure of gaseous fuel within fuel rail 36. One or more exhaust sensors 76 may include one or more emissions sensors, such as NOx sensors, configured to generate a signal indicative of a quantity of substances, including NOx, present in the exhaust gas at one or more locations of an exhaust system. Exhaust sensors 76 may also include temperature sensors to measure a temperature of the exhaust gas at one or more locations within the exhaust system. An engine speed sensor 78 may be configured to generate a signal indicative of an operating speed of engine 14, such as a speed indicated by the rotation of crankshaft 20.

ECM 80 may be in operable communication with each sensor of sensor system 70 to receive feedback information in the form of data from each sensor. ECM 80 may also be in operable communication with valve 38 and ITV 46, and may be configured to generate control signals to control one or more valves 38 and ITV 46. Additionally, ECM 80 may be configured to receive an output request 60. In some aspects, output request 60 may correspond to a requested amount of power (e.g., electrical power) generated with engine 14. Output request 60 may, additionally or alternatively, correspond to a request for propulsion power generated with engine 14, or any other suitable output.

Figure 3:
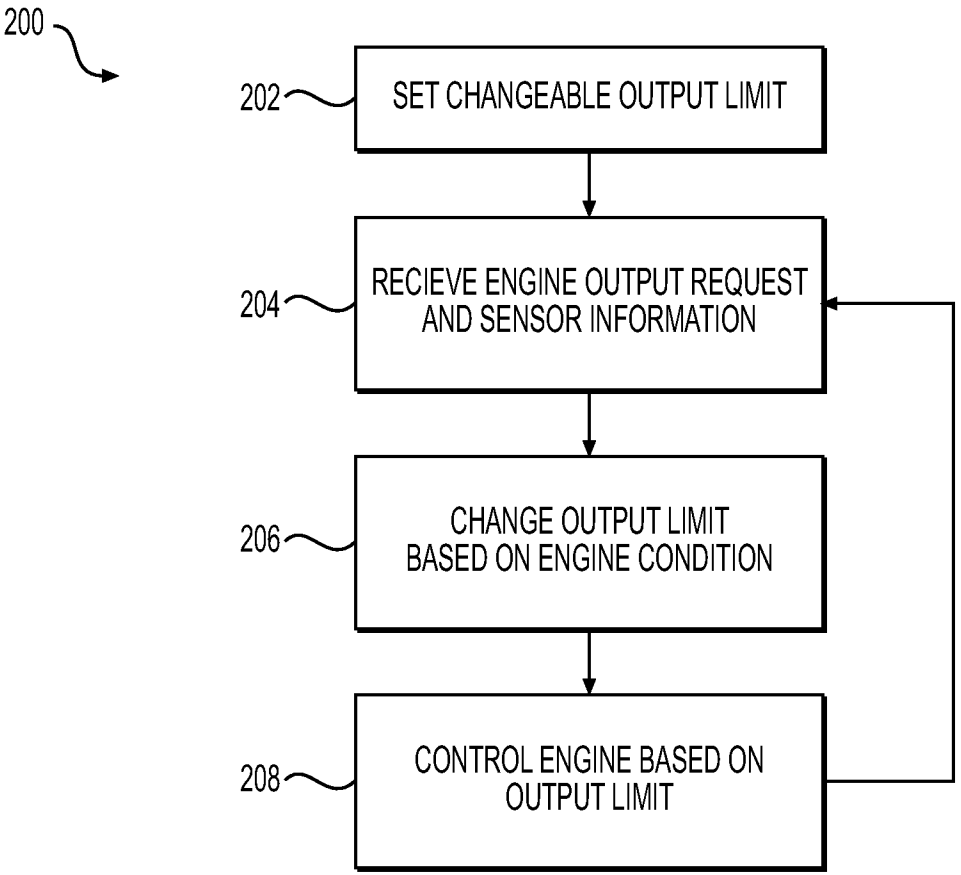
FIG. 3 is a flowchart illustrating an exemplary method according to an aspect of the present disclosure.
Figure 4:
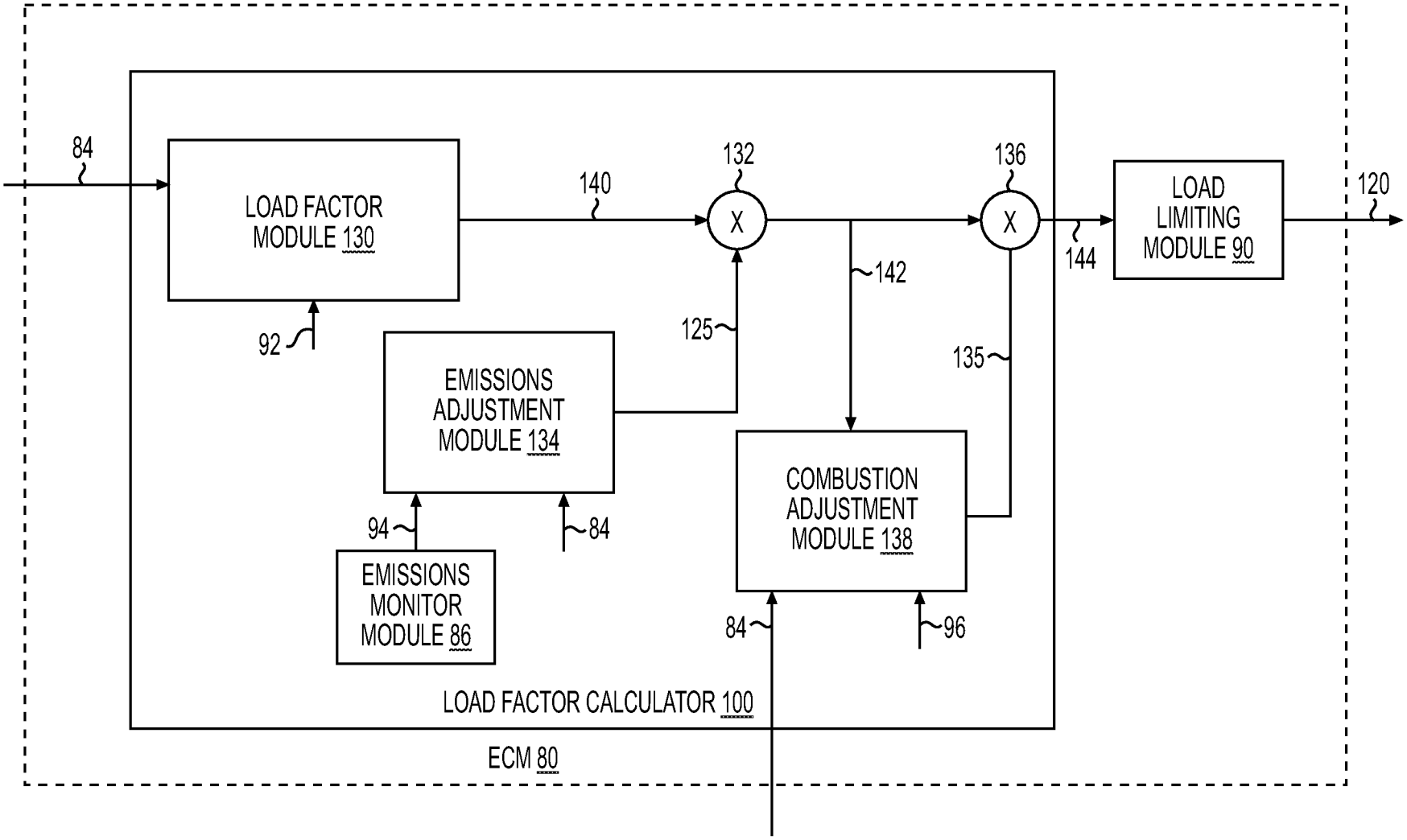
FIG. 4 is a block diagram illustrating an exemplary configuration of the control module of the engine load control system of FIG. 1 for determining load.

ECM 80 may embody a single microprocessor or multiple microprocessors that receive inputs (e.g., from sensor system 70) and issue control signals or other outputs. ECM 80 may include a memory, a secondary storage device, and at least one processor, such as a central processing unit or any other means for accomplishing a task consistent with the present disclosure. The memory or secondary storage device associated with ECM 80 may store data and software to allow ECM 80 to perform its functions, including each of the functions described with respect to method 200 (FIG. 3). In particular, such data and software in memory or secondary storage device(s) may allow ECM 80 to perform the functions associated with load limiting module 90 (FIG. 2), load factor module 130, emissions monitor module 86, emissions adjustment module 134, and/or combustion adjustment module 138 (FIG. 4). Numerous commercially available microprocessors can be configured to perform the functions of ECM 80. Various other known circuits may be associated with ECM 80, including signal-conditioning circuitry, communication circuitry, and other appropriate circuitry.

Figure 2:
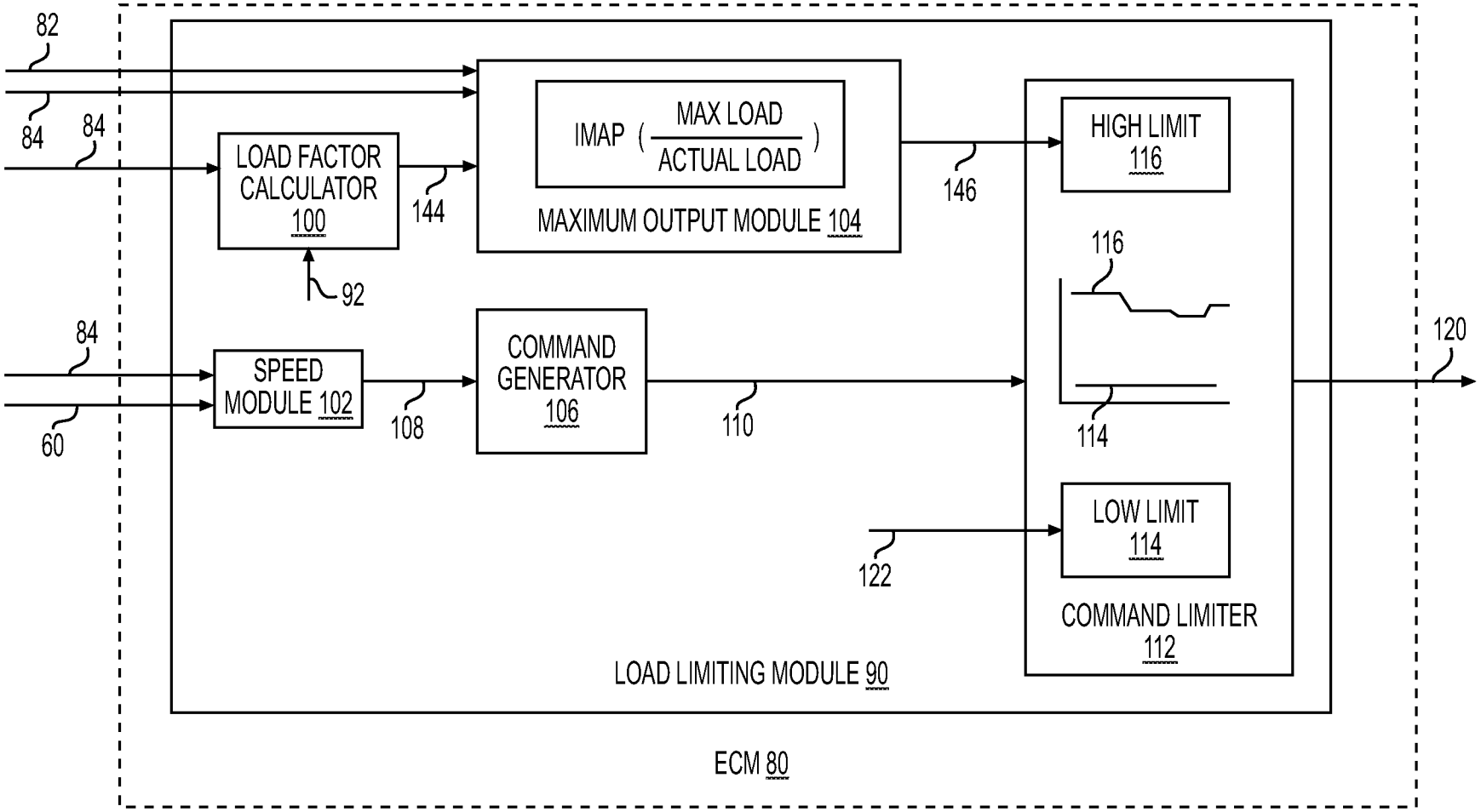
FIG. 2 is a block diagram illustrating an exemplary configuration of a control module of the engine load control system of FIG. 1 for controlling load.

FIG. 2 illustrates an exemplary configuration of ECM 80 useful for performing load limiting with engine system 10. As illustrated in FIG. 2, ECM 80 may include a load limiting module 90 that includes a load factor calculator 100, maximum output module 104, speed module 102, command generator 106, and a command limiter 112.

Load factor calculator 100 may receive, as inputs, engine speed signal 84 and fuel rate 92, and may output a load factor 144. Load factor calculator 100 may include one or more maps or lookup tables representative of a relationship between a plurality of load factors and respective engine speed and fuel rate pairs such that each engine speed and fuel rate pair corresponds to a particular load factor. Load factor 144 may correspond to an estimated current load of engine 14, with respect to the maximum desired or rated load of engine 14. As one example, load factor may be expressed as a relationship between a current amount of supplied fuel to a maximum amount of supplied fuel, for a particular speed of engine 14. A load factor of 100%, for example, may indicate that the quantity of fuel is equal to the maximum quantity of fuel for a particular engine speed. A load factor greater than 100% may indicate that the quantity of supplied fuel is greater than this maximum rate. In another embodiment, load factor 144 may instead represent a particular power output by engine 14 (e.g., as measured in kW) instead of a quantity of fuel supplied to engine 14, if desired. Load factor 144 may represent a corrected load factor, as described below. However, if desired, an uncorrected load factor (e.g., load factor 140 described below with respect to FIG. 4), may be output by load factor calculator 100.

Maximum output module 104 may receive, as inputs, an intake pressure signal 82, an engine speed signal 84, and the load factor 144 output from load factor calculator 100. Maximum output module 104 may provide, as an output, a command to set or change a high limit 116 of command limiter 112. Signal 82 may be generated by intake sensor 72, and may correspond to an intake pressure, such as a measured IMAP.

Speed module 102 of load limiting module 90 may receive, as inputs, an engine speed signal 84 generated by sensor 78 and output request 60, such as a requested amount of power. Speed module 102 may output a speed error 108 that is received by command generator 106. Speed error 108 may represent a difference between a current engine speed and a desired engine speed. Command generator 106 may be configured to issue a desired output command 110 to command limiter 112 based on speed error 108. Command generator 106 may perform proportional-integral control to facilitate control of engine speed based on speed error 108. Output command 110 may correspond to a command for ITV 46 that achieves a particular IMAP. For example, output command 110 may correspond to a position of ITV 46 that is based on speed error 108 and will tend to reduce the difference between the current engine speed and the desired engine speed, thereby reducing speed error 108. In at least some applications, such as power generation, engine 14 may tend to be operated at relatively constant speeds. Accordingly, speed error 108 may tend to be relatively low for extended periods of time. However, during this time, the load on engine 14 may remain relatively high.

In addition to the above-described high limit command 146 and desired output command 110, command limiter 112 may receive a low limit command 122. Low limit command 122 may correspond to a constant value stored in a memory of ECM 80, such as zero. Based on limits 122 and 146, command limiter 112 may generate an output command 120, such as an IMAP command, to control a throttle for engine 14. Command limiter 112 may be implemented as a saturation block, for example, that generates output command 120. Output command 120 may, for example, correspond to a desired position of ITV 46 to achieve a desired IMAP (e.g., an IMAP value within bounds defined by low limit 114 and high limit 116).

FIG. 4 illustrates an exemplary configuration of load factor calculator 100 of load limiting module 90 (FIG. 2). It is noted that load factor calculator 100 may be used with other aspects of ECM 80. In exemplary configurations, load factor calculator 100 may include a load factor module 130, an emissions monitor module 86, an emissions adjustment module 134 (e.g., a module configured to output a load factor correction based on an emissions condition), and a combustion adjustment module 138 (e.g., a module configured to output a load factor correction based on a combustion condition). Adjustments or corrections may be performed by first and second correctors 132, 136 (e.g., multipliers, adders, etc.). Load factor calculator 100 may output a corrected load factor 144 to load limiting module 90 and/or to another component of load limiting module 90, such as maximum output module 104 (see also FIG. 2).

Load factor module 130 may receive, as inputs, engine speed signal 84 and a fuel rate 92. Fuel rate 92 may correspond to a fuel rate associated with a current operating state of engine 14, as calculated by ECM 80. For example, fuel rate 92 may be calculated based on a desired mass of fuel, and may be determined based on an initial calibration of engine 14. Thus, fuel rate 92 may correspond to a desired fuel rate for an engine 14 operating at nominal conditions, and may be determined with use of a map or lookup table. These nominal conditions may include, for example, air-fuel ratio, NOx, and timing conditions of engine 14, among others. If desired, fuel rate 92 may be determined based on signals from one or more sensors of sensor system 70, such as fuel sensor 74. Load factor module 130 may determine, and output, a load factor 140 that is received by first adjuster or corrector 132. Load factor 140 may be either a corrected or an uncorrected load factor and may be calculated with use of one or more maps or lookup tables.

Emissions monitor module 86 may be configured to determine an emissions factor 94 (e.g., a NOx factor) that is received by emissions adjustment module 134. Emissions factor 94 may correspond to a difference between a target quantity of NOx output by engine 14 and an adjusted quantity of emissions. The target quantity of emissions, such as NOx, may correspond to an amount of NOx output by engine 14 when the engine 14 operates under calibration conditions (e.g., default emissions settings, such as air-fuel ratio, NOx, and timing settings). The adjusted quantity of emissions may correspond to a different amount of desired NOx set by an operator, e.g., a technician, by interfacing with ECM 80 or another control module associated with engine 14. It may be desirable to adjust emissions (e.g., desired NOx), for example, based on a type of fuel and/or a desired operation of engine 14. In particular, emissions settings may be useful for calibrating the operation of engine 14 based on the combustion characteristics of the particular gaseous fuel supplied to engine 14. Emissions adjustment module 134 may receive engine speed (e.g., engine speed signal 84) in addition to this emissions factor 94. Emissions adjustment module 134 may output an emissions correction (e.g., NOx correction) 125 received by adjuster 132 to adjust load factor 140. In some aspects, emissions adjustment module 134 may include one or more maps or lookup tables that define a relationship between a series of load factor adjustments and pairs of emissions factors 94 and engine speeds. Adjuster 132 may output a partially-corrected or a first adjusted load factor 142.

Combustion adjustment module 138 may receive, as inputs, the first adjusted load factor 142 from adjuster 132, as well as engine speed signal 84, and engine timing 96. Engine timing 96 may correspond to a current engine timing, such as an ignition timing (e.g., a timing of a start of ignition initiated by spark plug). This timing may be determined by ECM 80 based on an adjusted timing input by an operator, such as a technician. Similar to the emissions adjustment, it may be desirable to adjust engine timing based on particular gaseous fuel and/or a desired operation of engine 14. For example, timing settings may be adjusted based on the combustion characteristics of the particular gaseous fuel employed. Combustion adjustment module 138 may output a combustion adjustment 135 to second adjuster 136. Combustion adjustment 135 may take into account the combustion timing adjustment, and may be representative of an advanced or retarded timing, as compared to a standard timing. Combustion adjustment module 138 may include, for example, a plurality of maps or lookup tables that define a relationship between a series of load factor adjustments and pairs of engine timings 96 and engine speeds 84. Moreover, the plurality of maps (e.g., map slices), may take into account an adjusted timing 96, if any, input by the operator. Based on combustion adjustment 135, second adjuster 136 may output a second adjusted or fully-corrected load factor 144 to load limiting module 90. In some aspects, fully-corrected load factor 144 may be determined based on only engine speed 84, fuel rate 92, emissions, and timing. However, if desired, additional corrections or adjustments may be employed to determine fully-corrected load factor 144, such as one or more of waste gate setting, intake restriction, exhaust restriction, and coolant temperature (e.g., water jacket temperature).

INDUSTRIAL APPLICABILITY

Engine load control system 10 may be used with any appropriate machine or vehicle that includes an internal combustion engine, such as engine 14. In particular, engine load control system 10 may be employed on gaseous fuel internal combustion engine systems, such as power generators, as well as dual-fuel power generators or machines or vehicles that incorporate similar engine systems. During the operation of system 10, when fuel is combusted within a plurality of combustion chambers 16, ECM 80 may monitor and control operations of air and fuel system 34, including fuel metering valve 38, ITV 46, and ignition device 28. ECM 80 may monitor the status of various engine systems via sensor system 70, and may monitor the state of one or more components of engine 14 and air and fuel system 34.

During the operation of engine 14, relatively large output requests 60, such as requests for a desired power output, may be received by ECM 80. These large output requests 60 may tend to cause engine 14 to operate at high loads, and possibly at loads that exceed a rated load (e.g., load factors in excess of 100%). The systems of FIGS. 2 and 4 and the method 200 may assist in controlling an engine 14 so as to avoid operating at undesirably-high loads and/or in improving the accuracy of load determination.

FIG. 3 is a flowchart illustrating an exemplary process or method 200 that may be performed with system 10, including ECM 80. In a step 202, ECM 80 may set a changeable output limit associated with engine 14. For example, as shown in FIG. 2, maximum output module 104 may output an initial high limit command 146. This high limit command 146, which may allow ECM 80 to set changeable output limit 116, may be calculated based on intake pressure signal 82 and a load factor 140 or corrected load factor 144. Alternatively, an initial value of output limit 116 may be a predetermined threshold value stored in a memory of ECM 80.

In an exemplary configuration, module 104 may be configured to receive an intake pressure signal 82 that corresponds to pressure, or IMAP, within intake manifold 50. Module 104 may perform a calculation to determine a high limit 116 using this IMAP value, according to:

$$\text{HIGH LIMIT} = IMAP\left(\frac{\text{MAX LOAD}}{\text{ACTUAL LOAD}}\right),$$

where IMAP represents the current IMAP measured or calculated based on sensor 72, for example, MAX LOAD corresponds to a maximum desired (e.g., rated) load of engine 14, and ACTUAL LOAD represents a current load that may correspond to load factor 144. In particular, MAX LOAD may be a value that changes according to a current speed of engine 14 as measured, for example, with sensor 78. As such, MAX LOAD may be a value stored in one or more maps or lookup tables, for example, that define a relationship between maximum load and engine speed. Module 104 may generate high limit command 146 to set high limit 116 to the value determined by $$IMAP\left(\frac{\text{MAX LOAD}}{\text{ACTUAL LOAD}}\right).$$

Accordingly, the magnitude of high limit command 146 may be based on the ratio of maximum load and current load. As the maximum load may take engine speed into account, high limit command 146 may also be based on engine speed.

In a step 204, ECM 80 may receive an output request 60, which may correspond to a change in a requested output of engine 14. For example, request 60 may increase as more power is desired from engine 14. Step 204 may further include receiving sensor information from one or more sensors of sensor system 70. In particular, during step 204, ECM 80 may receive an intake pressure signal 82 representative of pressure, such as IMAP, from intake sensor 72 and an engine speed signal 84 representative of engine speed from engine speed sensor 78. Step 204 may be performed continuously during the operation of engine 14 and throughout the performance of method 200.

Step 206 may include changing an output limit based on a condition of engine 14. For example, step 206 may include changing output limit 116 based on engine speed and, in particular, load of engine 14. For example, with reference to FIG. 2, high limit 116 may be changed based on high limit command 146, so as to define a changed limit. In particular, as values of MAX LOAD and ACTUAL LOAD of maximum output module 104 change during the operation of engine 14, the magnitude of high limit command 146 may similarly change. The changed limit may be either higher or lower than the output limit 116 prior to the change. For example, as illustrated by command limiter 112 in FIG. 2, high limit 116 may increase and decrease periodically. Such increases and decreases in the value of high limit 116 may be based, for example, on changes in speed and changes in the current IMAP of engine 14. However, as MAX LOAD may be based on engine speed, in cases where IMAP and ACTUAL LOAD remain constant or approximately constant, high limit command 146 and, in turn, high limit 116, may change based on a change in engine speed and a corresponding change in the maximum permissible load (MAX LOAD). If desired, step 206 may be performed with use of load factor calculator 100 as illustrated in FIG. 4 in order to generate a corrected load factor 144 that is used by maximum output module 104 to calculate high limit command 146.

Step 208 may include controlling engine 14 based on an output limit, such as the changed high limit 116. If desired, the output limit may also include low limit 114. For example, command limiter 112 may generate an output command 120 for controlling engine 14, such as a throttle or ITV command, that is limited by high limit 116. When command 110 is larger than high limit 116 (e.g., command 110 corresponds to an IMAP that is larger than an IMAP associated with limit 116), output 120 may be limited to the value of high limit 116. Such a limited command may place a throttle, such as ITV 46, in a position that is more restrictive as compared to a position associated with request 60 (e.g., were command 110 equal to or lower than limit 116), so as to reduce IMAP and a quantity of fuel provided to engine 14. Command 120 may be equal to command 110 when command 110 has a value between limits 114 and 116. Low limit 114 may be a minimum value (e.g., zero), based on low limit command 122. Command 120 may be equal to low limit 114 when command 110 has a value lower than low limit 114.

Some engines, and in particular, gas compression engines, may have a tendency to operate at high loads corresponding to load factors that exceed 100%. While it may be desirable to extract as much power from an engine as possible, operating an engine at loads that approach safe limits for engine equipment may be challenging, especially for engines that rely upon fixed thresholds associated with hardware limitations. For example, these hardware limitations may be relevant only to extreme operating conditions. By providing a changeable limit and adjusting a maximum permitted output of an engine according to operating conditions, it may be possible to more accurately prevent the engine from overshooting the maximum load factor while allowing the engine to operate at or near the maximum load factor. Additionally, by adjusting a load factor based on changes in emissions and timing, it may be possible to more accurately calculate the load factor. This more accurate load factor may take into account emissions and/or timing changes input by an operator to facilitate the use of a variety of gaseous fuels, including gaseous fuels having differing characteristics, such as different methane contents and combustion characteristics. Such strategies may prevent an operator from continuously operating an engine at a load factor in excess of 100%, which may prolong the life of one or more components of the engine, may reduce the frequency of maintenance and/or repair, and may reduce downtime.

It will be apparent to those skilled in the art that various modifications and variations can be made to the disclosed method and system without departing from the scope of the disclosure. Other embodiments of the method and system will be apparent to those skilled in the art from consideration of the specification and practice of the method and system disclosed herein. It is intended that the specification and examples be considered as exemplary only, with a true scope of the disclosure being indicated by the following claims and their equivalents.

What is claimed is:

1. A method for controlling an internal combustion engine, the method comprising:

receiving a request for a power or torque output from the internal combustion engine at an engine control module;

receiving sensor information indicative of at least an engine speed or a pressure of air and fuel supplied to the internal combustion engine at the engine control module;

determining a pressure limit for the air and fuel supplied to the internal combustion engine with the engine control module, the pressure limit representing a maximum permitted pressure of the air and fuel;

determining a throttle valve position based on the pressure limit for the supply of air and fuel to the internal combustion engine with the engine control module;

based at least in part on the received sensor information indicative of at least the engine speed or the pressure of air and fuel supplied to the internal combustion engine, changing the pressure limit and changing the throttle valve position to a more restrictive position with the engine control module in response to the changed pressure limit; and reducing the power or torque output from the internal combustion engine by the changed throttle valve position with the engine control module based on the changed pressure limit.

2. The method of claim 1, wherein changing the pressure limit is performed based at least in part on the engine speed.

3. The method of claim 1, wherein changing the pressure limit is performed based at least in part on a load factor of the internal combustion engine.

4. The method of claim 3, wherein the load factor is determined based at least in part on a combustion condition.

5. The method of claim 4, wherein the combustion condition is an engine timing.

6. The method of claim 1, wherein reducing the power or torque output from the internal combustion engine includes reducing the pressure of the supply of air and fuel to the internal combustion engine.

7. The method of claim 6, wherein the throttle valve is connected downstream of a fuel supply.

8. The method of claim 1, wherein the air and fuel supplied to the internal combustion engine is a mixture of air and gaseous fuel.

9. The method of claim 1, further including increasing the pressure limit to define an increased pressure limit based at least in part on the received sensor information.

10. The method of claim 1, further including:

determining a request pressure for the air and fuel based on the request for the power or torque output from the internal combustion engine;

determining that the request pressure is larger than the pressure limit; and in response to determining that the request pressure exceeds the pressure limit, controlling the internal combustion engine based on the pressure limit.

11. An internal combustion engine control system, comprising:

an internal combustion engine;

a throttle valve;

an intake manifold;

a sensor configured to generate a signal indicative of an engine speed; and a controller configured to:

receive the signal indicative of the engine speed;

set a throttle valve position for a desired power or torque output from the internal combustion engine;

determine an intake manifold pressure limit of air and fuel supplied to the internal combustion engine through the intake manifold;

based at least in part on the signal indicative of the engine speed, reduce the pressure limit to define a changed intake manifold pressure limit; and generate a command signal to change the throttle valve position to a more restrictive position based on the changed intake manifold pressure limit.

12. The system of claim 11, wherein the controller is configured to change the intake manifold pressure limit based at least in part on a load factor and the engine speed of the internal combustion engine.

13. The system of claim 12, wherein the controller is configured to determine the load factor based at least in part on an engine timing.

14. The system of claim 11, wherein the throttle valve is positioned downstream of an intake air inlet and a fuel gas supply.

15. A method for determining a load factor of an internal combustion engine, the method comprising:

receiving, at an engine control module, an engine speed signal from a sensor;

determining a load factor with the engine control module, based on at least the engine speed signal;

igniting fuel in the internal combustion engine at an ignition timing;

determining an emissions condition based on a desired emissions condition received at the engine control module;

adjusting the load factor with the engine control module, based on at least one of the emissions condition of the internal combustion engine or the ignition timing of the internal combustion engine, to determine a corrected load factor;

determining a pressure limit representing a maximum permitted pressure of air and fuel supplied to the internal combustion engine; and operating the internal combustion engine based at least in part on the corrected load factor and the pressure limit.

16. The method of claim 15, wherein adjusting the load factor includes:

performing a first adjustment of an initial load factor, based on the emissions condition of the internal combustion engine, to determine a first corrected load factor;

adjusting the first corrected load factor, based on the ignition timing of the internal combustion engine, to determine a second corrected load factor; and operating the internal combustion engine based at least in part on the second corrected load factor.

17. The method of claim 15, wherein the emissions condition is an amount of NOx associated with the internal combustion engine.

18. The method of claim 15, wherein the load factor is determined based on the engine speed signal and a fuel rate of fuel supplied to the internal combustion engine.

19. The method of claim 18, wherein the fuel rate is a rate of gaseous fuel.

* * * * *